US009022554B2

(12) United States Patent
Kato

(10) Patent No.: US 9,022,554 B2
(45) Date of Patent: May 5, 2015

(54) LIQUID EJECTING APPARATUS AND MEDIUM TRANSPORT APPARATUS WITH AN INTER-AXIS ADJUSTMENT MECHANISM

(71) Applicant: Seiko Epson Corporation, Tokyo (JP)

(72) Inventor: Shigeki Kato, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/179,275

(22) Filed: Feb. 12, 2014

(65) Prior Publication Data

US 2014/0285603 A1 Sep. 25, 2014

(30) Foreign Application Priority Data

Mar. 19, 2013 (JP) ..... 2013-056186

(51) Int. Cl.

| | |
|---|---|
| ***B41J 2/01*** | (2006.01) |
| ***B41J 13/02*** | (2006.01) |
| ***B65H 23/02*** | (2006.01) |
| ***B65H 27/00*** | (2006.01) |
| *B41J 15/04* | (2006.01) |

(52) U.S. Cl.

CPC ..... *B41J 13/025* (2013.01); *B41J 15/04* (2013.01); *B65H 23/02* (2013.01); *B65H 27/00* (2013.01); *B65H 2404/1431* (2013.01); *B65H 2404/1531* (2013.01); *B65H 2511/214* (2013.01); *B65H 2511/224* (2013.01)

(58) Field of Classification Search

USPC ..... 347/104, 101

See application file for complete search history.

(56) References Cited

U.S. PATENT DOCUMENTS 5,742,318 A * 4/1998 Miyauchi et al. ..... 347/134

FOREIGN PATENT DOCUMENTS

JP 02-293172 12/1990

* cited by examiner

*Primary Examiner* — Henok Legesse

(74) *Attorney, Agent, or Firm* — Workman Nydegger

(57) ABSTRACT

A liquid ejecting apparatus, including: a liquid ejecting section that ejects a liquid at a medium; a transport mechanism that is disposed downstream of the liquid ejecting section in a transport direction of the medium and transports the medium, the transport mechanism having a driving roller that makes driving rotation, and a pair of driven rollers that are pressed against the driving roller via the medium and make driven rotation, the driven rollers being disposed with a space in a direction to cross the transport direction; and an inter-axis adjustment mechanism that is capable of adjusting an inter-axis distance between a rotation axis of the driving roller and a rotation axis of each roller of the driven rollers separately.

6 Claims, 6 Drawing Sheets

LIQUID EJECTING APPARATUS AND MEDIUM TRANSPORT APPARATUS WITH AN INTER-AXIS ADJUSTMENT MECHANISM

BACKGROUND

1. Technical Field

The present invention relates to a liquid ejecting apparatus and a medium transport apparatus.

2. Related Art

As an exemplary liquid ejecting apparatus, an ink jet printer provided with a head that ejects ink (a liquid) at a medium, such as a paper sheet, and a transport mechanism that transports the medium is proposed. As an exemplary transport mechanism, a mechanism in which a medium is pulled by a transport roller pair that is rotated while pinching the medium is proposed. A first roller of the transport roller pair is pressed against a second roller by an elastic member, such as a spring. In such a mechanism, however, since the ink is not fixed to the medium immediately after printing, an image will be degraded when the medium is pinched by a long transport roller pair. Then, a transport mechanism in which both end portions in a width direction of a medium are pinched and pulled by a long roller and a pair of short rollers that are pressed against the long roller via the medium has been proposed (see JP-A-2-293172).

SUMMARY

However, if each roller of a pair of short rollers has different pressure contact force to a long roller, a medium will be transported in an oblique or a meandering manner. Especially, in a case in which the short rollers are pressed against the long roller by an elastic member, if the elastic member of each roller of the pair of short rollers undergoes different temporal change, the tendency of oblique transportation and meandering of the medium increases with time.

An advantage of some aspects of the invention is to properly transport the medium by a transport roller pair in which a pair of short rollers are disposed to face a long roller.

A main invention for solving the problem is a liquid ejecting apparatus, including: a liquid ejecting section that ejects a liquid at a medium; a transport mechanism that is disposed downstream of the liquid ejecting section in a transport direction of the medium and transports the medium, the transport mechanism having a driving roller that makes driving rotation, and a pair of driven rollers that are pressed against the driving roller via the medium and make driven rotation, the driven rollers being disposed with a space in a direction to cross the transport direction; and an inter-axis adjustment mechanism that is capable of adjusting an inter-axis distance between a rotation axis of the driving roller and a rotation axis of each roller of the driven rollers separately.

Other features of the invention will become obvious from the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Outline of Disclosure

Figure 1:
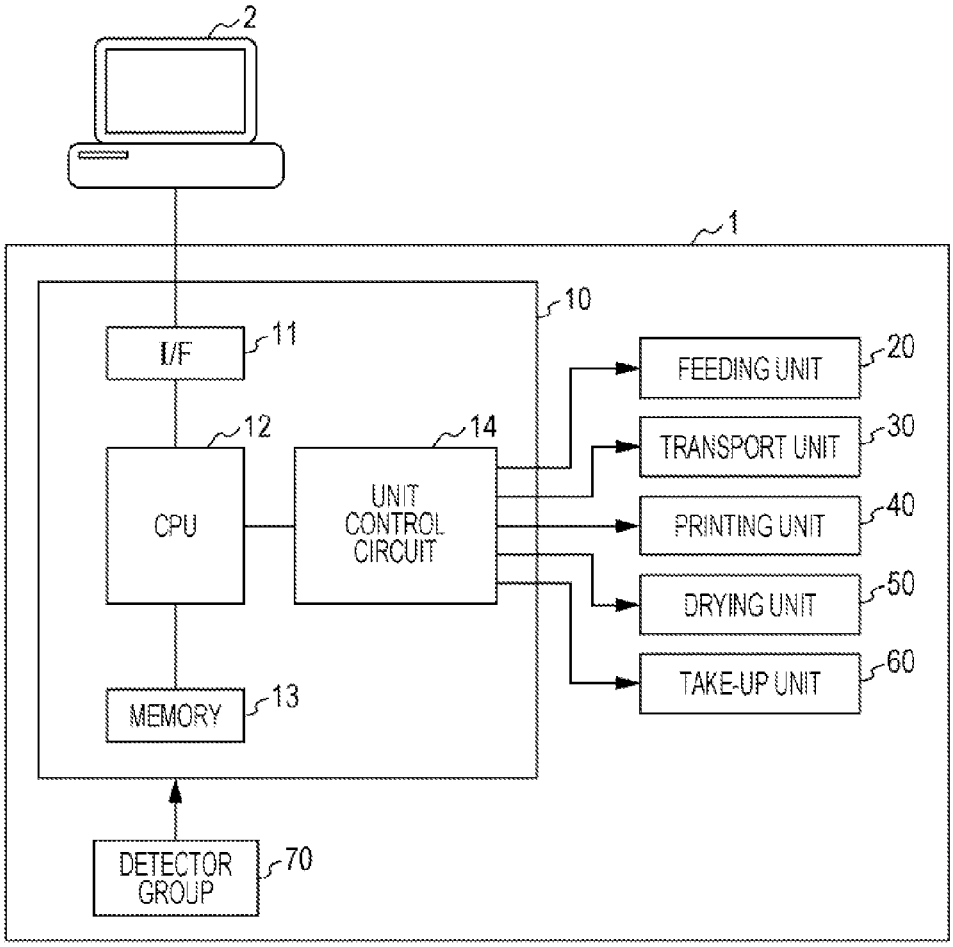
FIG. 1 is a block diagram illustrating an entire structure of a print system.

At least the following will become obvious from the specification and the accompanying drawings.

A liquid ejecting apparatus, including: a liquid ejecting section that ejects a liquid at a medium; a transport mechanism that is disposed downstream of the liquid ejecting section in a transport direction of the medium and transports the medium, the transport mechanism having a driving roller that makes driving rotation, and a pair of driven rollers that are pressed against the driving roller via the medium and make driven rotation, the driven rollers being disposed with a space in a direction to cross the transport direction; and an inter-axis adjustment mechanism that is capable of adjusting an inter-axis distance between a rotation axis of the driving roller and a rotation axis of each roller of the driven rollers separately.

According to such a liquid ejecting apparatus, for example, each roller of the pair of driven rollers may have equal pressure contact force with respect to the driving roller, and the medium may be pinched at both ends thereof in a width direction (a direction which crosses a transport direction) by the driving roller and the driven rollers with equal force (i.e., nipping force). Therefore, oblique transportation and meandering of the medium may be prevented and proper transportation of the medium may be implemented.

In the liquid ejecting apparatus, each roller of the pair of driven rollers is separately pivotable about a press contact direction with respect to the driving roller.

According to such a liquid ejecting apparatus, a transport direction of the medium may be adjusted more precisely and, oblique transportation and meandering of the medium may be prevented more reliably.

In the liquid ejecting apparatus, the inter-axis adjustment mechanism has, for each roller of the driven rollers, a main body and a support member to which the driven roller is rotatably attached; and an insertion hole provided in the support member in which a tightening member is inserted to attach the support member to the main body is an elongated hole extending in the press contact direction.

According to such a liquid ejecting apparatus, the inter-axis distance between the rotation axis of the driving roller and the rotation axis of each driven roller may be adjusted separately for each driven roller.

In the liquid ejecting apparatus, the support member has a first member to which the driven roller is attached and a second member in which the elongated hole is provided, the first member being attached to the main body via the second member; and the driven roller is made to pivot about the press contact direction when a mounting angle of the first member with respect to the second member is adjusted.

According to such a liquid ejecting apparatus, each roller of the pair of driven rollers may be made to pivot about the press contact direction against the driving roller.

In the liquid ejecting apparatus, the inter-axis adjustment mechanism adjusts the inter-axis distance by moving the driven roller with respect to the driving roller in the press contact direction by a screw mechanism.

According to such a liquid ejecting apparatus, the inter-axis distance between the rotation axis of the driving roller and the rotation axis of each driven roller may be adjusted precisely and easily.

A medium transport apparatus that transports a medium at which a liquid has been ejected, including: a driving roller that makes driving rotation, and a pair of driven rollers that are pressed against the driving roller via the medium and make driven rotation, the driven rollers being disposed with a space in a direction to cross the transport direction of the medium; and an inter-axis adjustment mechanism that is capable of adjusting an inter-axis distance between a rotation axis of the driving roller and a rotation axis of each roller of the driven rollers separately.

According to such a medium transport apparatus, for example, each roller of the pair of driven rollers may have equal pressure contact force with respect to the driving roller, and the medium may be pinched at both ends thereof in a width direction (a direction which crosses a transport direction) by the driving roller and the driven rollers with equal force (i.e., nipping force). Therefore, oblique transportation and meandering of the medium may be prevented and proper transportation of the medium may be implemented.

Print System

Figure 2:
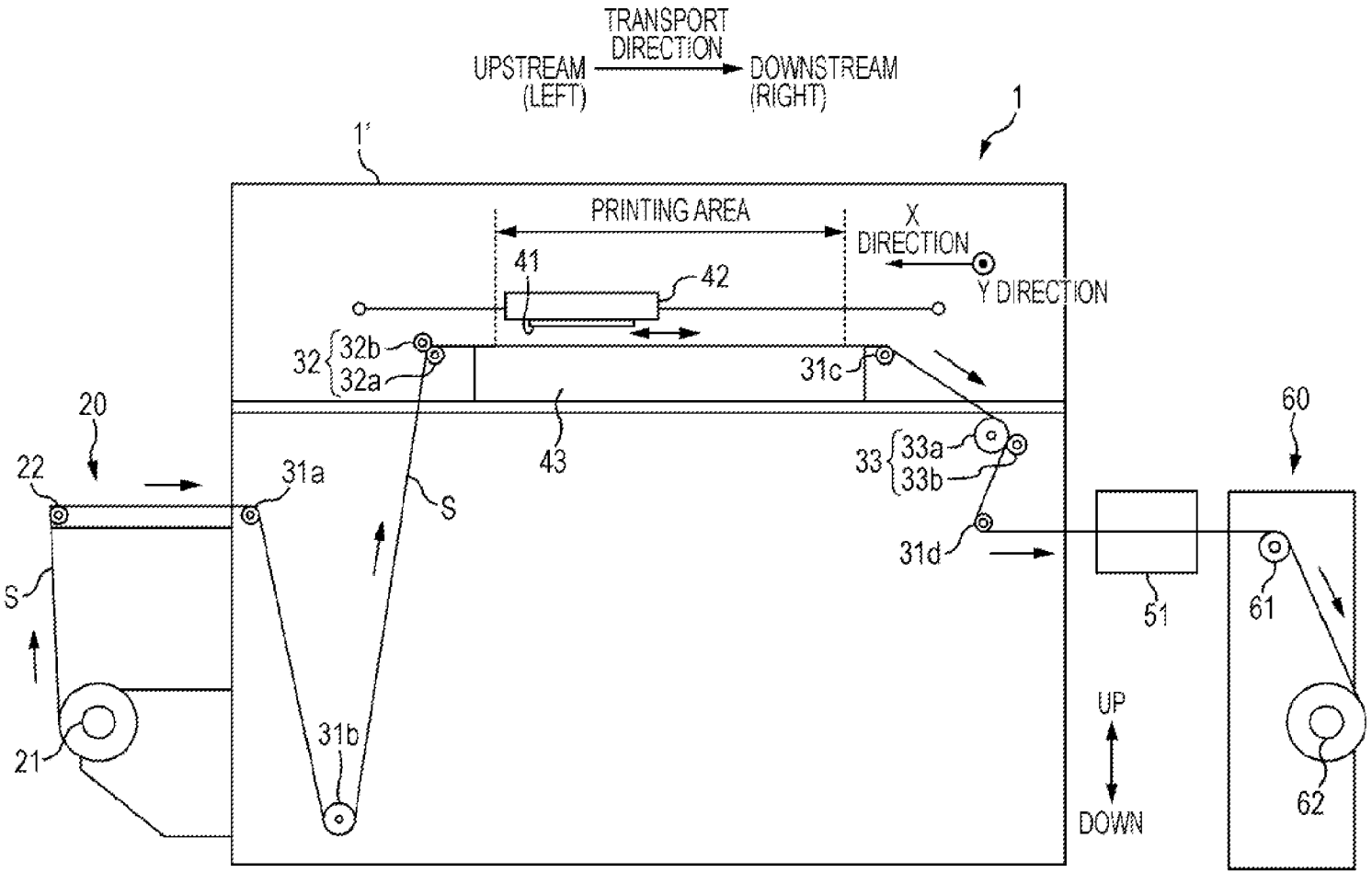
FIG. 2 is a schematic cross-sectional view of a printer.

Hereinafter, embodiments will be described with reference to a print system in which a printing device (an ink jet printer: hereafter, a printer) and a computer are connected to each other. FIG. 1 is a block diagram illustrating an entire structure of the print system and FIG. 2 is a schematic cross-sectional view of a printer 1. The printer 1 is connected to a computer 2 in a communicable manner. A printer driver installed in the computer 2 generates print data and outputs the generated data to the printer 1. The printer 1 prints an image using the print data. The printer 1 includes a controller 10, a feeding unit 20, a transport unit 30, a printing unit 40, a drying unit 50, a take-up unit 60 and a detector group 70.

The controller 10 in the printer 1 is for performing the entire control of the printer 1. An interface section 11 transmits data to and receives data from the computer 2 which is an external device. A CPU 12 is an arithmetic processing unit for performing the entire control of the printer 1 and controls each unit via a unit control circuit 14. Memory 13 is for securing areas for storing programs of the CPU 12, workspaces and the like. The condition of the printer 1 is monitored by the detector group 70. The controller 10 controls in accordance with the detection result from the detector group 70.

The feeding unit 20 is disposed upstream of a main body 1' of the printer 1 in a transport direction, and feeds, to the main body 1', a continuous paper sheet (hereafter, continuous paper) which is taken up in a roll form. The feeding unit 20 includes a reel 21 and a relay roller 22. The reel 21 rotatably supports continuous paper S which is taken up in a roll form. The continuous paper S is fed out when the reel is rotated. The continuous paper S fed out from the reel 21 is wound around the relay roller 22 and is guided to the main body 1'. The medium on which an image is to be printed by the printer 1 is not limited to the continuous paper S: cut sheets, cloth, film or the like may also be used.

The transport unit 30 includes a plurality of relay rollers 31*a* to 31*d*, an upstream side transport roller pair 32 and a downstream side transport roller pair 33. The continuous paper S is wound around the relay rollers 31*a* to 31*d* and fed. The upstream side transport roller pair 32 is disposed upstream of a printing area in the transport direction and the downstream side transport roller pair 33 is disposed downstream of the printing area in the transport direction. These rollers are disposed inside the main body 1'.

The upstream side transport roller pair 32 consists of an upstream side driving roller 32*a* and an upstream side driven roller 32*b*. The upstream side driving roller 32*a* is connected to a motor (not illustrated) and makes driving rotation. The upstream side driven roller 32*b* is pressed against the upstream side driving roller 32*a* via the continuous paper S and makes driven rotation. In a state in which the upstream side transport roller pair 32 pinches the continuous paper S, when the upstream side driving roller 32*a* makes driving rotation, transporting force is applied to the continuous paper S, then the continuous paper S fed from the feeding unit 20 is transported to the printing area via the relay rollers 31*a* and 31*b* and the upstream side transport roller pair 32.

Similarly, the downstream side transport roller pair 33 (which corresponds to a transport mechanism) consists of a downstream side driving roller 33*a* (which corresponds to a driving roller) and downstream side driven rollers 33*b*. The downstream side driving roller 33*a* is connected to a motor (which is denoted by the reference numeral 5 in the later-described FIG. 3) and makes driving rotation. The downstream side driven rollers 33*b* are pressed against the downstream side driving roller 33*a* via the continuous paper S and make driven rotation. In a state in which the downstream side transport roller pair 33 pinches the continuous paper S, when the downstream side driving roller 33*a* makes driving rotation, transporting force is applied to the continuous paper S, then the continuous paper S discharged from the printing area is transported out of the main body 1' via the relay rollers 31*c* and 31*d* and the downstream side transport roller pair 33.

The printing unit 40 includes a head 41 (which corresponds to a liquid ejecting section) which ejects ink (liquid), a carriage 42 which moves the head 41, and a platen 43 which supports the continuous paper S from the opposite side of a printing surface in the printing area. A large number of nozzles (i.e., openings) through which the ink is ejected are provided on a surface of the head 41 which faces the continuous paper S (i.e., a lower surface of the head 41). The ink ejecting system from the nozzles may be a piezo system in which a voltage is applied to driving elements (i.e., piezoelectric elements) to expand and contract an ink chamber so as to eject the ink through the nozzles; or a thermal system in which air bubbles are generated in the nozzles using a heating element and the ink is ejected through the nozzles by the air bubbles.

The carriage 42 moves the head 41 in X direction which is a transport direction of the continuous paper S and in Y direction (which is a width direction of the continuous paper S) with respect to the continuous paper S in the printing area (on the platen 43). Y direction crosses X direction (here, crosses perpendicularly). A two-dimensional image is printed on the continuous paper S in the printing area when an operation in which the ink is ejected while the head 41 is moved by the carriage 42 in X direction and an operation in which the head 41 is moved in Y direction are repeated (i.e., an image formation operation). During the image formation operation, the upstream side transport roller pair 32 and the downstream side transport roller pair 33 temporarily stop the transportation of the continuous paper S. When the image formation operation is completed, the upstream side transport roller pair 32 and the downstream side transport roller pair 33 discharge a portion of the continuous paper S on which the image is printed out of the printing area, and then feed a part of the continuous paper S on which no image has been printed to the printing area (i.e., a transport operation). When the image formation operation and the transport operation are repeated in this manner, images are printed along the continuous direction of the continuous paper S.

The drying unit 50 includes a drying furnace 51 which has a heater (not illustrated) provided therein. The drying furnace 51 is disposed downstream of the main body 1' in the transport direction and heats the continuous paper S transported from the downstream side transport roller pair 33 in the drying furnace 51. Therefore, drying of the image printed on the continuous paper S is accelerated.

The take-up unit 60 includes a relay roller 61 and a take-up driving shaft 62. The continuous paper S discharged from the drying furnace 51 is wound around the relay roller 61 and is fed. The take-up driving shaft 62 takes up the continuous paper S fed from the relay roller 61. When the take-up driving shaft 62 makes driving rotation, the continuous paper S on which the image has been printed is sequentially taken up in a roll form.

Downstream Side Transport Roller Pair 33

Figure 3A:
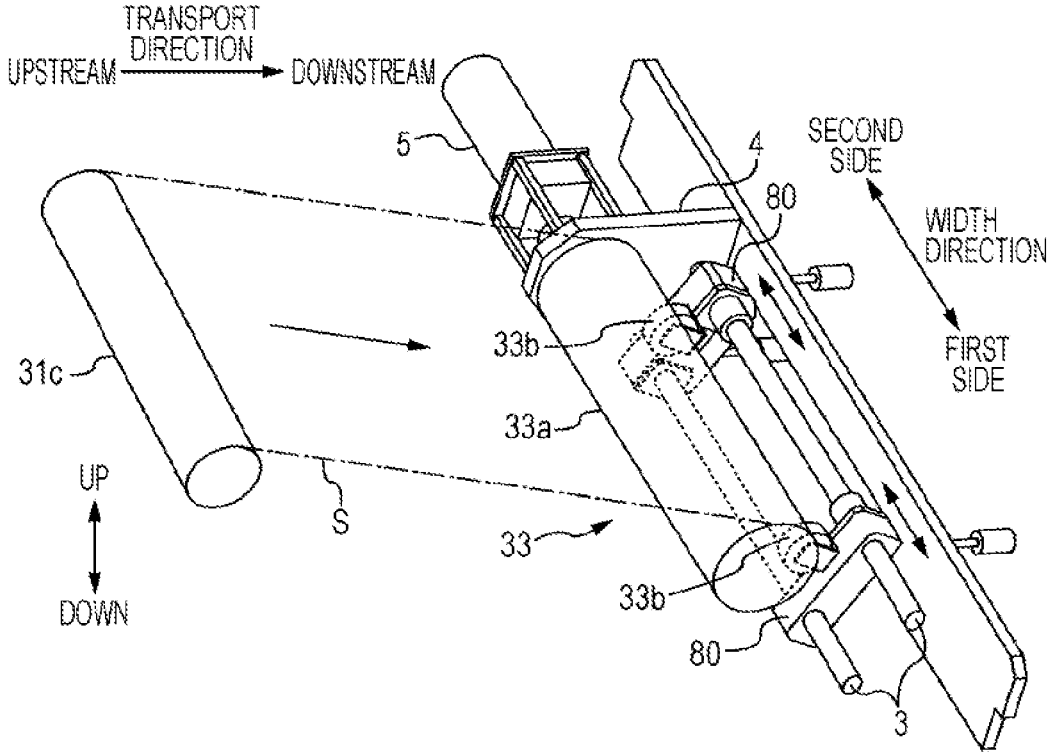
FIG. 3A is a schematic perspective view of components near a downstream side transport roller pair.
Figure 3B:
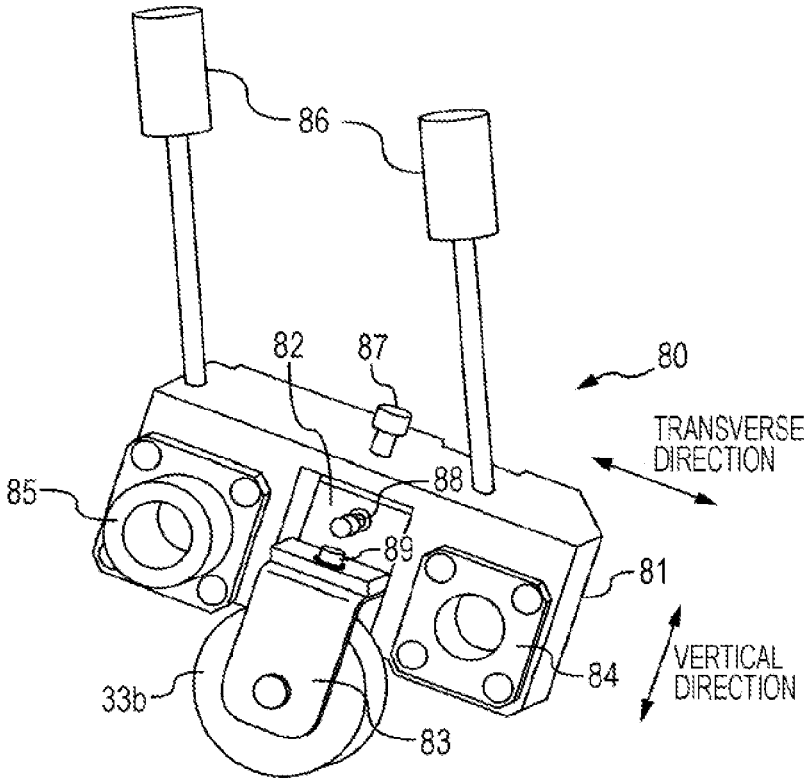
FIG. 3B is a perspective view of an adjusting unit of a downstream side driven roller.
Figure 4A:
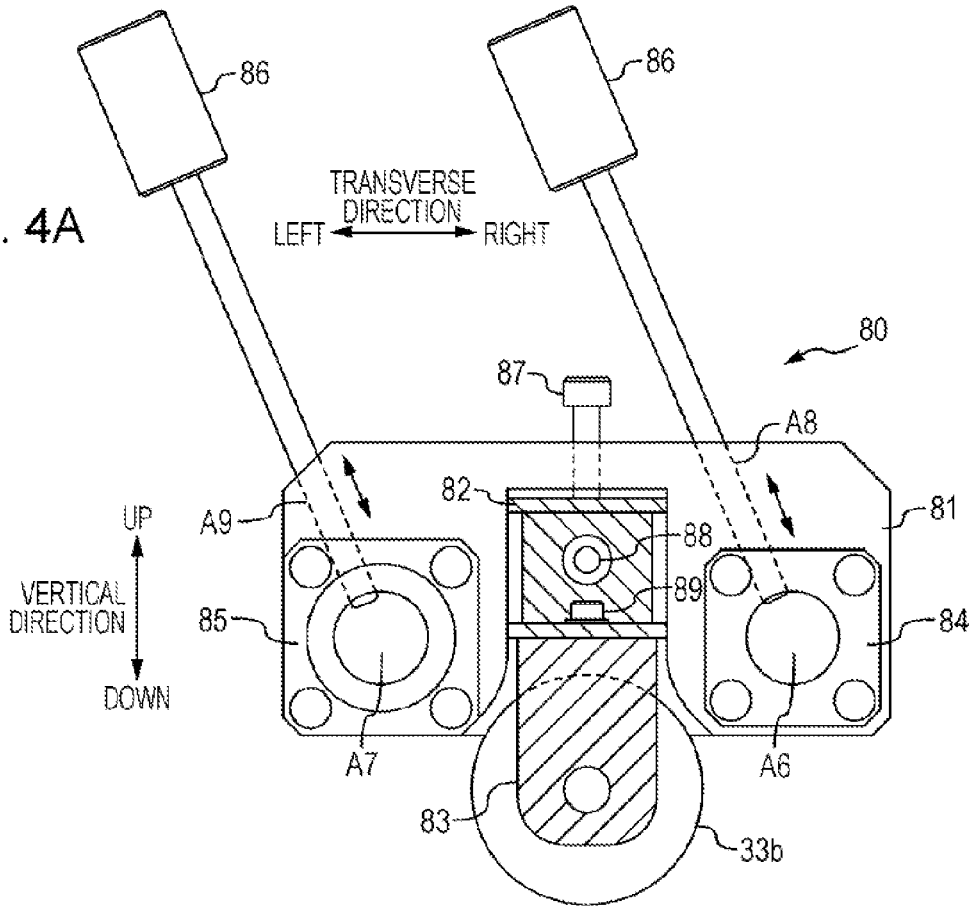
FIG. 4A is a front view of the adjusting unit.
Figure 4B:
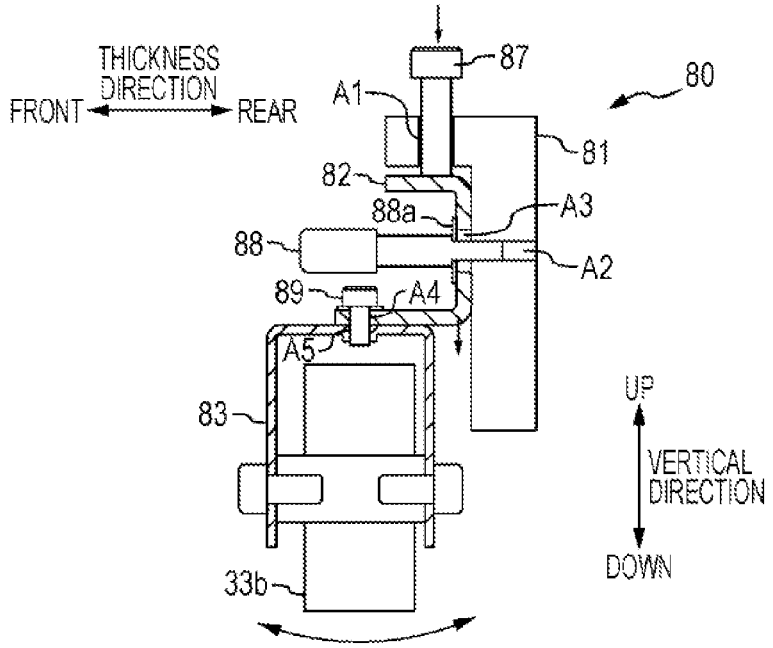
FIG. 4B is a cross-sectional view of the adjusting unit.
Figure 5A:
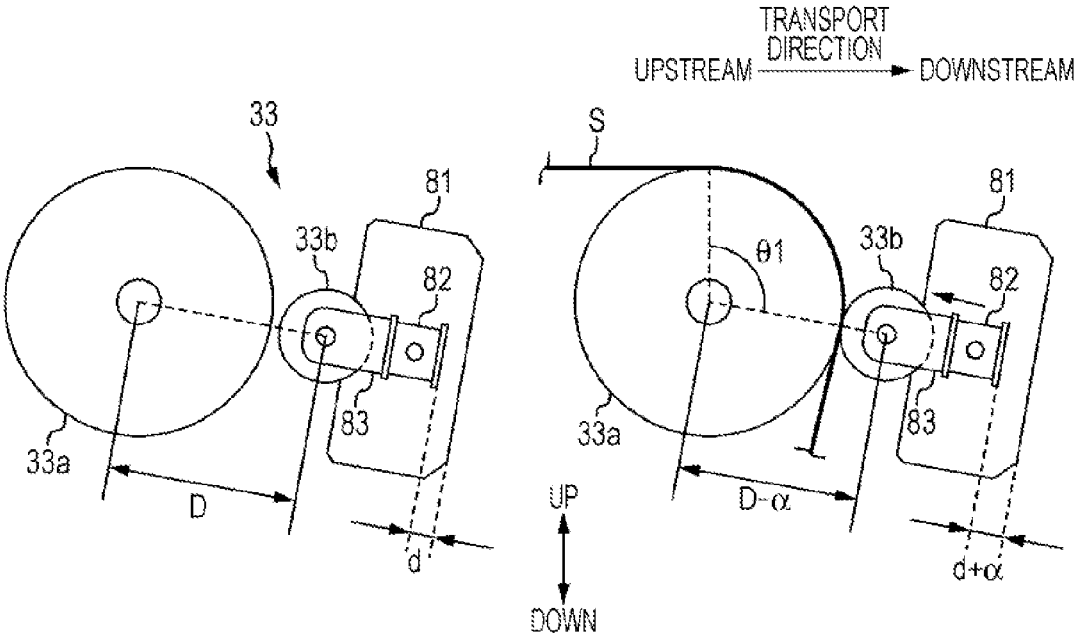
FIG. 5A is a diagram illustrating adjustment of an inter-axis distance of the downstream side transport roller pair.
Figure 5B:
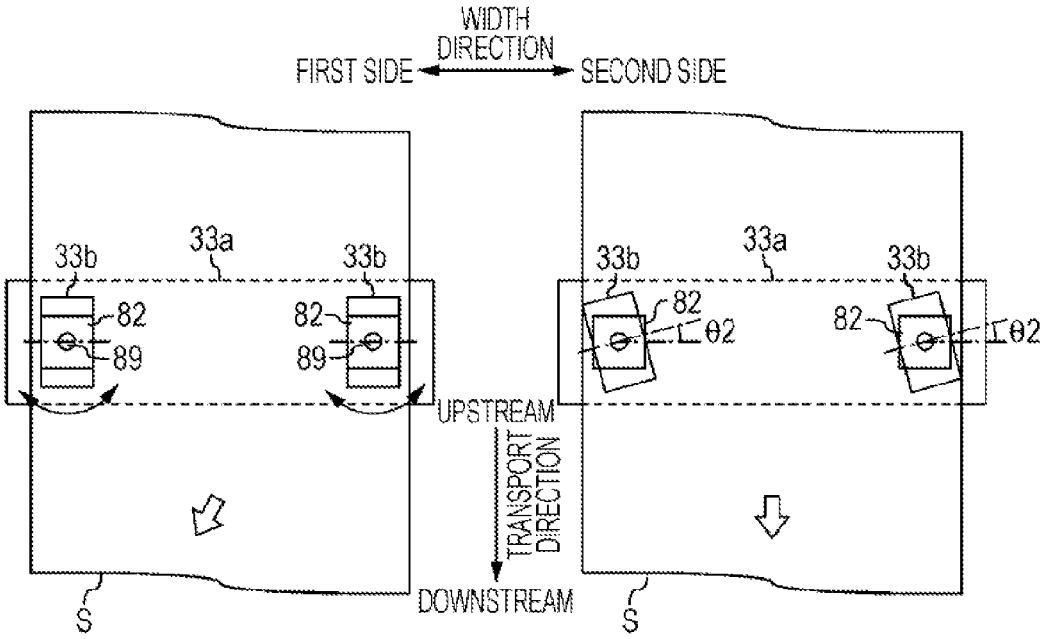
FIG. 5B is a diagram illustrating adjustment of an angle of the downstream side driven roller.

FIG. 3A is a schematic perspective view of components near the downstream side transport roller pair 33. FIG. 3B is a perspective view of an adjusting unit 80 of the downstream side driven roller 33*b*. FIG. 4A is a front view of the adjusting unit 80 and FIG. 4B is a cross-sectional view of the adjusting unit 80. FIG. 4B is a cross-sectional view of the adjusting unit 80 along the central portion in a transverse direction. FIG. 5A is a diagram illustrating adjustment of an inter-axis distance between rollers constituting the downstream side transport roller pair 33. FIG. 5B is a diagram illustrating adjustment of an angle of the downstream side driven roller 33*b*.

In the printer 1 of the present embodiment (see FIG. 2), the downstream side transport roller pair 33 is disposed downstream of the printing area in the transport direction, and is upstream of the drying furnace 51 in the transport direction. Therefore, the downstream side transport roller pair 33 may pinch the continuous paper S with insufficiently dried ink applied thereon, and may apply transporting force to the continuous paper S. Therefore, the downstream side driving roller 33*a* which is in contact with the surface of the continuous paper S on the side opposite to the side of the printing surface may be a long roller extending in the width direction longer than the paper width of the continuous paper S as illustrated in FIG. 3A. On the other hand, the downstream side driven roller 33*b* which is in contact with the printing surface of the continuous paper S is a short roller having a short length in the width direction because the downstream side driven roller 33*b* may be in contact with portions of the continuous paper S in which no image is printed, i.e., margin at both ends in the width direction of the continuous paper S. That is, two downstream side driven rollers 33*b* are disposed with a space therebetween in the width direction with respect to the long downstream side driving roller 33*a* and, since the downstream side transport roller pair 33 pinches the margin at both ends in the width direction of the continuous paper S, adhesion of the ink to the downstream side transport roller pair 33 and removal of the ink from the continuous paper S may be prevented.

A surface of the downstream side driving roller 33*a* is made of metal and a surface of the downstream side driven roller 33*b* is made of an elastic member, such as rubber. Therefore, the downstream side driven roller 33*b* may be pressed against the downstream side driving roller 33*a* via the continuous paper S by elastic force of an elastic member which constitutes the downstream side driven roller 33*b* and transporting force is applied to the continuous paper S by frictional force between the downstream side transport roller pair 33 and the continuous paper S. Note that the surface of the downstream side driving roller 33*a* may be made of an elastic member, the surface of the downstream side driven roller 33*b* may be made of metal, and surfaces of both rollers 33*a* and 33*b* may be made of an elastic member. The downstream side driven roller 33*b* may be pressed against the downstream side driving roller 33*a* by an elastic member, such as a spring.

As described above, the transporting force may be applied to the continuous paper S when the downstream side driven roller 33*b* is pressed against the downstream side driving roller 33*a* by an elastic member, such as rubber and a spring. As in the present embodiment, however, in a case in which two downstream side driven rollers 33*b* are provided with respect to the downstream side driving roller 33*a*, if each roller of the pair of downstream side driven rollers 33*b* has different pressure contact force to the downstream side driving roller 33*a*, the continuous paper S may be pinched with unequal nipping force at both ends in the width direction and thus the continuous paper S may be transported in an oblique or a meandering manner. Further, even if the nipping force at both ends in the width direction of the continuous paper S is adjusted at the time of initial operation, if the elastic member which constitutes each of the downstream side driven rollers 33*b* undergoes different temporal change (e.g., wear of rubber, curing of rubber, deterioration in spring force and the like), the continuous paper S is again transported in an oblique or a meandering manner. As a result, the ink is not able to be landed at appropriate positions on the continuous paper S and, therefore, deterioration in image quality of the print image may be caused or the continuous paper S being transported may be jammed. When the pressure contact force of the downstream side transport roller pair 33 is lowered due to temporal change of the elastic member which constitutes the downstream side driven roller 33*b*, it may become impossible to apply transporting force to the continuous paper S.

Then, in the printer 1 of the present embodiment, as illustrated in FIG. 5A, the inter-axis distance between the rotation axis of the downstream side driving roller 33*a* and the rotation axis of each roller of the pair of downstream side driven rollers 33*b* may be adjusted separately for each downstream side driven roller 33*b*. Further, as illustrated in FIG. 5B, each roller of the pair of downstream side driven rollers 33*b* may be made to pivot about the press contact direction with respect to the downstream side driving roller 33*a* (i.e., a direction which perpendicularly crosses the continuous paper S at a nip point). Therefore, each roller of the pair of downstream side driven rollers 33*b* is attached separately to the adjusting unit 80. The adjusting unit 80 includes a main body 81, an inter-axis adjusting member 82, a roller support member 83, a first penetrating member 84, a second penetrating member 85, locking screws 86, a first inter-axis adjusting screw 87, a second inter-axis adjusting screw 88 and an angle adjustment key 89. In FIGS. 3B, 4A and 4B, the adjusting unit 80 to which the downstream side driven roller 33*b* of a second side in the width direction is to be attached is illustrated.

As illustrated in FIG. 3B, the central portion in the transverse direction of a front surface of the main body 81 of the adjusting unit 80 is recessed from both end portions. As illustrated in FIG. 4B, at the central portion in the transverse direction of the main body 81, an upper portion projects to the front in the thickness direction with respect to a side portion extending in a vertical direction. A hole A1 is provided to penetrate, in the vertical direction, the upper portion projecting to the front in the thickness direction. The first inter-axis adjusting screw 87 is inserted in the hole A1. A hole A2 is provided in the side portion of the main body 81. The second inter-axis adjusting screw 88 is inserted in the hole A2 from the front surface in the thickness direction. The inter-axis adjusting member 82 is attached to the front surface of the side portion of the main body 81 in a fixed manner by the second inter-axis adjusting screw 88. The hole A1 of the main body 81 is threaded so that the first inter-axis adjusting screw 87 is screwed therein. The hole A2 is threaded so that the second inter-axis adjusting screw 88 is screwed therein.

The inter-axis adjusting member 82 (which corresponds to a support member and a second member) includes a plate-shaped upper portion, a plate-shaped lower portion and a plate-shaped side portion. The side portion is connected to rear end portions of the upper and lower portions along the thickness direction. The inter-axis adjusting member 82 is attached to the main body 81 such that a rear surface of the side portion of the inter-axis adjusting member 82 is in contact with a front surface of the side portion of the main body 81. Therefore, a hole A3 is provided in the side portion of the inter-axis adjusting member 82 and the second inter-axis adjusting screw 88 is inserted therein. The hole A3 is an elongated hole extending in the vertical direction. Therefore, a mounting position of the inter-axis adjusting member 82 to the main body 81 is variable along the vertical direction. A shaft of the second inter-axis adjusting screw 88 has a stepped portion in the middle thereof. The second inter-axis adjusting screw 88 is tightened via a washer 88*a* of the size to cover the elongated hole A3 disposed between the stepped portion and the inter-axis adjusting member 82. A hole A4 is provided to penetrate, in the vertical direction, the lower portion of the inter-axis adjusting member 82 in which the angle adjustment key 89 is inserted. The hole A4 is threaded so that the angle adjustment key 89 is screwed therein.

The roller support member 83 (which corresponds to a support member and a first member) includes two plate-shaped side portions which face each other in the thickness direction and a plate-shaped upper portion which connects the upper ends of the side portions. As illustrated in FIG. 4B, the driven roller 33*b* is rotatably attached to the roller support member 83 in a state in which the driven roller 33*b* is disposed between the two side portions of the roller support member 83. A hole A5 is provided in the upper portion of the roller support member 83 and the angle adjustment key 89 is inserted therein. The hole A5 is threaded so that the angle adjustment key 89 is screwed therein. When the angle adjustment key 89 is inserted in the hole A4 of the inter-axis adjusting member 82 and in the hole A5 of the roller support member 83 and is tightened, the roller support member 83 is attached to the inter-axis adjusting member 82 in a fixed manner. That is, the roller support member 83 is attached to the main body 81 via the inter-axis adjusting member 82.

On the front surface of the adjusting unit 80, the first penetrating member 84 is attached to the right portion and the second penetrating member 85 is attached to the left portion. In the first penetrating member 84, a hole A6 is provided to penetrate, in the thickness direction, the central portion of a substantially square base. In the second penetrating member 85, a cylindrical portion projecting to the front in the thickness direction is connected to the substantially square base, and a hole A7 is provided to penetrate the cylindrical portion and the base in the thickness direction. The main body 81 also includes a hole A6 and a hole A7. The hole A6 communicates with the hole A6 of the first penetrating member 84 and penetrates the main body 1 in the thickness direction. The hole A7 communicates with the hole A7 of the second penetrating member 85 and penetrates the main body 81 in the thickness direction.

The downstream side driving roller 33*a* is rotatably attached to side plates 4 which are provided at both outer portions in the width direction as illustrated in FIG. 3A. In FIG. 3A, one of the side plates in the width direction is excluded. At positions downstream of the downstream side driving roller 33*a* in the transport direction, two slide shafts 3 extending in the width direction are attached to the side plate 4 with a space therebetween in an up-down direction. The lower slide shaft 3 is disposed upstream of the upper slide shaft 3 in the transport direction. The adjusting unit 80 is attached to the slide shafts 3. That is, the first slide shaft 3 is inserted in the hole A6 of the first penetrating member 84 of the adjusting unit 80 and in the hole A6 of the main body 81, and the second slide shaft 3 is inserted in the hole A7 of the second penetrating member 85 of the adjusting unit 80 and in the hole A7 of the main body 81. Therefore, the downstream side driven rollers 33*b* are disposed to face the downstream side driving roller 33*a*.

The slide shafts 3 are attached to the side plates 4 such that the downstream side driven rollers 33*b* face a portion on an outer peripheral surface of the downstream side driving roller 33*a*, the portion being on the downstream side in the transport direction and being slightly below the central portion in the up-down direction. In this manner, as illustrated in FIG. 5A, a take-up angle θ1 of the continuous paper S to the downstream side driving roller 33*a* may be relatively increased. The take-up angle θ1 may be increased to be equal to or greater than a take-up angle at which frictional force necessary for the transportation of the continuous paper S is obtained, and thus appropriate transporting force for the continuous paper S may be applied. The take-up angle θ1 is an angle which forms an arc from a position at which take-up of the continuous paper S on the outer peripheral surface of the downstream side driving roller 33*a* is started to a position at which the take-up is ended (the nip point).

The adjusting unit 80 attached to the slide shafts 3 is slidable in the width direction depending on the width of the continuous paper S or the position at which the continuous paper S is transported. The position of the adjusting unit 80 with respect to the slide shafts 3 is fixed by locking screws 86. Two locking screws 86 are provided in the adjusting unit 80. The locking screws 86 are inserted in the holes A8 and A9 which are provided to penetrate the main body 81 of the adjusting unit 80 from above to reach the holes A6 and A7 in which the slide shafts 3 are inserted, respectively. The holes A8 and A9 are threaded so that the locking screws 86 are screwed therein. When the locking screws 86 are tightened into the holes A8 and A9 of the main body 81 and tip portions of the locking screws 86 are pressed against the slide shafts 3, the position of the adjusting unit 80 with respect to the slide shafts 3 is fixed. Although both of the two adjusting units 80 are slidable in the width direction in the present embodiment, the position of one of the adjusting units 80 may be fixed.

In the thus-configured adjusting unit 80, the insertion hole A3 provided in the inter-axis adjusting member 82 and in which the second inter-axis adjusting screw 88 (which corresponds to a tightening member) that attaches the inter-axis adjusting member 82 (which corresponds to a support member) to the main body 81 of the adjusting unit 80 is an elongated hole extending in the press contact direction (i.e., the vertical direction in the adjusting unit 80) of the downstream side transport roller pair 33. Therefore, the inter-axis adjusting member 82 may be moved toward the downstream side driving roller 33*a* with respect to the main body 81. Therefore, as illustrated in FIG. 5A, the inter-axis distance between the rotation axis of the downstream side driving roller 33*a* and the rotation axis of the downstream side driven roller 33*b* may be adjusted (in particular, the inter-axis distance in the press contact direction in which the downstream side driven roller 33*b* is pressed against the downstream side driving roller 33*a* may be adjusted).

Suppose, for example, as illustrated in the left figure of FIG. 5A, that an inter-axis distance (D) between the rollers constituting the downstream side transport roller pair 33 has increased due to temporal change of the elastic member which constitutes the downstream side driven roller 33*b* and the downstream side driven roller 33*b* is not able to be pressed against the downstream side driving roller 33*a* or pressed with reduced pressure contact force. In that case, the second inter-axis adjusting screw 88 which attaches the inter-axis adjusting member 82 to the main body 81 of the adjusting unit 80 in a fixed manner is loosened, and then the first inter-axis adjusting screw 87 is tightened. Then, a tip portion of the first inter-axis adjusting screw 87 is made to be in contact with the upper portion of the inter-axis adjusting member 82 and the inter-axis adjusting member 82 is moved toward the downstream side driving roller 33*a* with respect to the main body 81. Since the downstream side driven roller 33*b* is attached to the inter-axis adjusting member 82 via the roller support member 83, the downstream side driven roller 33*b* is moved toward the downstream side driving roller 33*a* together with the inter-axis adjusting member 82. As a result, as illustrated in the right figure of FIG. 5A, a distance from the main body 81 of the adjusting unit 80 to the inter-axis adjusting member 82 increases (d to d+α) and the inter-axis distance between the downstream side driving roller 33*a* and the downstream side driven roller 33*b* decreases (D to D−α). Therefore, the pressure contact force of the downstream side driven roller 33*b* to the downstream side driving roller 33*a* increases.

With this configuration, since the inter-axis distance between the rollers constituting the downstream side transport roller pair 33 is adjustable, even if the pressure contact force of the downstream side transport roller pair 33 decreases due to temporal change of the elastic member, the pressure contact force may be increased by shortening the inter-axis distance between the rollers constituting the downstream side transport roller pair 33. Therefore, the continuous paper S may be nipped by the downstream side transport roller pair 33 so that the transporting force is applied to the continuous paper S, and the continuous paper S may be transported properly.

Further, since the adjusting unit 80 is provided in each roller of the pair of downstream side driven rollers 33*b*, the inter-axis distance between the downstream side driving roller 33*a* and each roller of the pair of downstream side driven rollers 33*b* may be adjusted separately. Therefore, even if each roller of the pair of downstream side driven rollers 33*b* undergoes different temporal change, each roller of the pair of downstream side driven rollers 33*b* may have equal pressure contact force with respect to the downstream side driving roller 33*a*, and the continuous paper S may be pinched at both ends thereof in the width direction with equal nipping force. Therefore, oblique transportation and meandering of the continuous paper S may be prevented and proper transportation of the continuous paper S may be implemented. The two adjusting units 80 to which the pair of downstream side driven rollers 33*b* are attached correspond to an inter-axis adjustment mechanism of the invention.

In addition, even if appropriate nipping force by the downstream side transport roller pair 33 varies depending on the characteristics of the medium to transport, the nipping force may be adjusted to be appropriate for each medium by adjusting the inter-axis distance between the rollers constituting the downstream side transport roller pair 33 by the adjusting units 80. That is, according to the downstream side transport roller pair 33 of the present embodiment, various medium may be transported properly.

Further, by moving the downstream side driven roller 33*b* in the press contact direction with respect to the downstream side driving roller 33*a* so as to adjust the inter-axis distance between the rollers constituting the downstream side transport roller pair 33 using the first inter-axis adjusting screw 87 (i.e., a screw mechanism) provided in the main body 81, the inter-axis distance may be adjusted precisely and easily. Although most of the adjustment is to decrease the inter-axis distance between the rollers constituting the downstream side transport roller pair 33, it is possible to increase the inter-axis distance between the rollers constituting the downstream side transport roller pair 33 by loosening the first inter-axis adjusting screw 87 and the second inter-axis adjusting screw 88 and then shifting the position of the inter-axis adjusting member 82 with respect to the main body 81 to the opposite side of the downstream side driving roller 33*a*.

Further, in the adjusting unit 80 of the present embodiment, the inter-axis adjusting member 82 and the roller support member 83 are formed as separate components and, by adjusting an angle of the roller support member 83 with respect to the inter-axis adjusting member 82, each roller of the pair of downstream side driven rollers 33*b* may be made to pivot separately about the press contact direction against the downstream side driving roller 33*a* as illustrated in FIG. 5B. That is, when seen from the press contact direction of the downstream side transport roller pair 33, the angle of the rotation axis of the downstream side driven roller 33*b* with respect to the width direction may be adjusted. Thus, the transport direction of the continuous paper S may be adjusted more precisely, and oblique transportation and meandering may be prevented more reliably.

Suppose, for example, as illustrated in the left figure of FIG. 5B, that the continuous paper S is transported obliquely toward a first side in the width direction when the rotation axes of the downstream side driven rollers 33*b* are along the width direction. In that case, after the angle adjustment key 89 of the adjusting unit 80 is loosened, as illustrated in the right figure of FIG. 5B, the roller support member 83 and the downstream side driven roller 33*b* are tilted counterclockwise by an angle θ2 about the angle adjustment key 89 with respect to the inter-axis adjusting member 82. Then, the downstream side driven roller 33*b* is oriented to the side opposite to the side on which the continuous paper S is transported obliquely, and thus the downstream side portion of the downstream side driven roller 33*b* in the transport direction is situated toward the second side in the width direction as compared with the upstream side portion. Therefore, oblique transportation of the continuous paper S may be stopped and the continuous paper S may be transported properly. Although the pair of downstream side driven rollers 33*b* are rotated in the same direction at the same angle in FIG. 5B, this configuration is not restrictive: the rollers may be rotated in different directions or at different angles.

Modified Embodiment

Figure 6A:
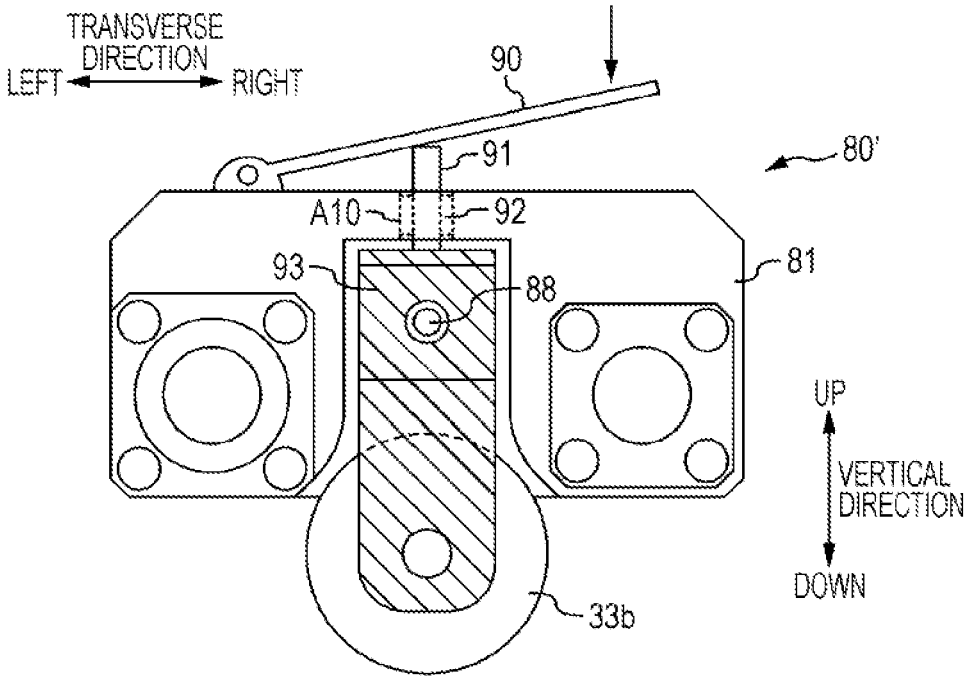
FIG. 6A is a diagram illustrating a modified embodiment of an adjusting unit of a downstream side driven roller.
Figure 6B:
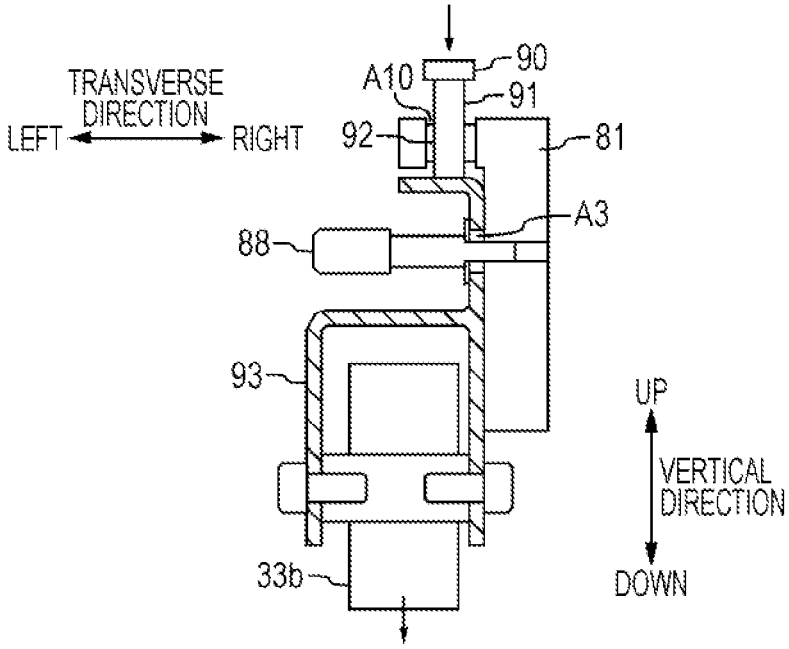
FIG. 6B is a diagram illustrating the modified embodiment of the adjusting unit of the downstream side driven roller.

FIGS. 6A and 6B are diagrams illustrating a modified embodiment of an adjusting unit 80' of a downstream side driven roller 33*b*. FIG. 6A is a front view of the adjusting unit 80' of the modified embodiment and FIG. 6B is a cross-sectional view of the adjusting unit 80' of the modified embodiment along the central portion in a transverse direction. In the adjusting unit 80 described above, although the downstream side driven rollers 33*b* may be made to pivot about the press contact direction of the downstream side transport roller pair 33 as illustrated in FIG. 5B, this configuration is not restrictive: a configuration in which the downstream side driven rollers 33*b* are not able to pivot about the press contact direction may also be adopted. In that case, as in the adjusting unit 80' of the modified embodiment, a roller support member 93 which rotatably supports the downstream side driven roller 33*b* may be directly attached to a main body 81 by a second inter-axis adjusting screw 88. Therefore, the number of parts may be small as compared with the above-described adjusting unit 80. A hole A3 may be provided in the roller support member 93 and the second inter-axis adjusting screw 88 may be inserted therein. The hole A3 is desirably an elongated hole extending in the vertical direction (i.e., the press contact direction). Then, the inter-axis distance between rollers consisting of a downstream side transport roller pair 33 may be adjusted by adjusting the position of the roller support member 93 along the vertical direction with respect to the main body 81.

In the adjusting unit 80 described above, the hole A1 provided in the upper portion of the main body 81 is threaded so that the first inter-axis adjusting screw 87 is screwed therein and the inter-axis distance between the rollers constituting the downstream side transport roller pair 33 is adjusted by tightening the first inter-axis adjusting screw 87: however, this configuration is not restrictive. For example, as in the adjusting unit 80' of the modified embodiment, a hole A10 which is not threaded is provided in the upper portion of the main body 81 and a linear shaft 91 may be inserted in the hole A10 via a linear bush 92. Then, the linear shaft 91 is pushed into the main body 81 by a lever 90 which is rotated about a fulcrum provided at a left side portion in the transverse direction on the upper portion of the main body 81. Then, the roller support member 93 is pushed by the linear shaft 91 and moved toward the downstream side driving roller 33*a*, whereby the inter-axis distance between the rollers constituting the downstream side transport roller pair 33 may be decreased.

Further, it is desirable to adjust the inter-axis distance between the rollers constituting the downstream side transport roller pair 33 by bringing the central portion of the lever 90 in the longitudinal direction into contact with the linear shaft 91 and moving a position of an end portion of the lever 90 at the opposite side of the fulcrum of the lever 90 (i.e., a right end portion in the transverse direction of the lever 90 in FIG. 6). Thus, an amount of adjustment of the lever 90 with respect to an amount of movement of the linear shaft 91 may be increased. For example, the inter-axis distance between the rollers constituting the downstream side transport roller pair 33 may be adjusted more precisely by moving the position of the end portion of the lever 90 by tightening a screw which is not illustrated.

Other Embodiments

The embodiment described above has been provided to make understanding of the invention easier, and not to limit the interpretation of the invention. The invention may be changed and improved without departing from the spirit and scope thereof. Obviously, the invention includes its equivalents.

The downstream side transport roller pair 33 and the adjusting units 80 in the embodiment described above may be applied as a medium transport apparatus in other apparatus than a printer. Although the printer 1 includes the drying furnace 51 in the embodiment described above, the printer 1 does not necessarily include a drying furnace 51.

In the embodiment described above, the printer 1 repeats the operation to print a two-dimensional image by moving the head 41 in X direction and Y direction with respect to the continuous medium situated in the printing area, and the operation to feed a new portion of the continuous medium to the printing area. However, the configuration is not restrictive. For example, a printer may repeat an operation to eject ink while a head is moved in a direction to cross a direction of a nozzle array (i.e., a main scanning direction), and an operation to transport a medium in the direction of the nozzle array (i.e., a sub-scanning direction or a direction in which the medium continues when a continuous medium is used). Alternatively, for example, a printer may repeat an operation to eject ink at a medium which is being moved in the main scanning direction with respect to a head, and an operation to move the medium in the sub-scanning direction with respect to the head. Further, for example, a printer may eject ink at a medium when the medium is being transported in a direction to cross the width direction below a head in which nozzles are arranged to form an array longer than the width of the medium.

The entire disclosure of Japanese Patent Application No. 2013-056186, filed Mar. 19, 2013 is expressly incorporated by reference herein.

What is claimed is:

1. A liquid ejecting apparatus, comprising:

a liquid ejecting section that ejects a liquid at a medium;

a transport mechanism that is disposed downstream of the liquid ejecting section in a transport direction of the medium and transports the medium, the transport mechanism having a driving roller that makes driving rotation, and a pair of driven rollers that are pressed against the driving roller via the medium and make driven rotation, the driven rollers being disposed with a space in a direction to cross the transport direction; and an inter-axis adjustment mechanism configured to adjust an inter-axis distance between a rotation axis of the driving roller and a rotation axis of each roller of the driven rollers separately, the inter-axis adjustment mechanism including for each roller of the driven rollers a main body and a support member to which the driven roller is rotatably attached, wherein the inter-axis adjustment mechanism adjusts the inter-axis distance by moving the driven roller toward the driving roller by increasing a distance of the support member from the main body, the distance corresponding to the distance the driven roller is moved toward the driving roller.

2. The liquid ejecting apparatus according to claim 1, wherein each roller of the pair of driven rollers is separately pivotable about a press contact direction with respect to the driving roller.

3. The liquid ejecting apparatus according to claim 2, wherein the inter-axis adjustment mechanism has, for each roller of the driven rollers, a main body and a support member to which the driven roller is rotatably attached; and wherein an insertion hole provided in the support member in which a tightening member is inserted to attach the support member to the main body is an elongated hole extending in the press contact direction.

4. The liquid ejecting apparatus according to claim 3, wherein the support member has a first member to which the driven roller is attached and a second member in which the elongated hole is provided, the first member being attached to the main body via the second member; and wherein the driven roller is made to pivot about the press contact direction when a mounting angle of the first member with respect to the second member is adjusted.

5. The liquid ejecting apparatus according to claim 1, wherein the inter-axis adjustment mechanism adjusts the inter-axis distance by moving the driven roller with respect to the driving roller in the press contact direction by a screw mechanism.

6. A medium transport apparatus that transports a medium at which a liquid has been ejected, comprising:

a driving roller that makes driving rotation, and a pair of driven rollers that are pressed against the driving roller via the medium and make driven rotation, the driven rollers being disposed with a space in a direction to cross the transport direction of the medium; and an inter-axis adjustment mechanism configured to adjust an inter-axis distance between a rotation axis of the driving roller and a rotation axis of each roller of the driven rollers separately, the inter-axis adjustment mechanism including for each roller of the driven rollers a main body and a support member to which the driven roller is rotatably attached , wherein the inter-axis adjustment mechanism adjusts the inter-axis distance by moving the driven roller toward the driving roller by moving increasing a distance of the support member from the main body, the distance corresponding to the distance the driven roller is moved toward the driving roller.

* * * * *